US006174129B1

(12) United States Patent
Mazzola et al.

(10) Patent No.: US 6,174,129 B1
(45) Date of Patent: Jan. 16, 2001

(54) TURBINE VANE CLOCKING MECHANISM AND METHOD OF ASSEMBLING A TURBINE HAVING SUCH A MECHANISM

(75) Inventors: Stefan Mazzola, Oviedo; Kent Goran Hultgren, Winter Park, both of FL (US)

(73) Assignee: Siemens Westinghouse Power Corporation, Orlando, FL (US)

( * ) Notice: Under 35 U.S.C. 154(b), the term of this patent shall be extended for 0 days.

(21) Appl. No.: 09/226,289

(22) Filed: Jan. 7, 1999

(51) Int. Cl.[7] ..... F01D 25/24
(52) U.S. Cl. ..... 415/127; 415/151; 415/189
(58) Field of Search ..... 415/148, 151, 415/157, 158, 185, 191, 208.1, 208.2, 209.2, 209.3, 127, 128, 189, 166, 202, 213.1; 29/889.2, 889.21, 889.22

(56) References Cited

U.S. PATENT DOCUMENTS

| | | | | |
|---|---|---|---|---|
| 2,971,333 | * | 2/1961 | Mendelsohn et al. | 415/202 |
| 4,046,487 | | 9/1977 | Lenz . | |
| 4,470,756 | | 9/1984 | Rigo et al. . | |
| 4,519,756 | | 5/1985 | Fenton . | |
| 4,657,480 | | 4/1987 | Pfeil . | |
| 4,699,566 | | 10/1987 | Miller . | |
| 4,810,165 | | 3/1989 | Greune et al. . | |
| 5,209,634 | | 5/1993 | Owczarek . | |
| 5,215,434 | | 6/1993 | Greune et al. . | |
| 5,224,825 | * | 7/1993 | Strang et al. | 415/209.3 |
| 5,466,122 | | 11/1995 | Charbonnel et al. . | |
| 5,486,091 | | 1/1996 | Sharma . | |
| 5,681,142 | | 10/1997 | Lewis . | |

* cited by examiner

*Primary Examiner*—Edward K. Look
*Assistant Examiner*—Hermes Rodriguez
(74) *Attorney, Agent, or Firm*—Eckert Seamans Cherin & Mellott, LLC

(57) ABSTRACT

A turbo-machine having a means for attaching the blade ring to the casing at a plurality of alternative radial positions to provide for a plurality of alternative clocking angles for a stage of stationary airfoils. The blade ring is provided with a plurality of notches that may selectively be aligned with a pin inserted through the casing. By rotating the blade ring so that a selected notch aligns with the pin, a selected clocking position may be achieved. Assembly with a different clocking angle is achieved by aligning the pin with a different notch. The notches may be provided at any location around the blade ring so long as they are separated by a radial distance which is a non-integer multiple of the segment angle.

10 Claims, 2 Drawing Sheets

TURBINE VANE CLOCKING MECHANISM AND METHOD OF ASSEMBLING A TURBINE HAVING SUCH A MECHANISM

FIELD OF THE INVENTION

This invention relates generally to the field of turbo-machines, and in particular to an apparatus and method for clocking of a second stage of stationary vanes in relation to the position of a first stage of stationary vanes in a turbine engine.

BACKGROUND OF THE INVENTION

Turbo-machines are known to include rows or stages of stationary airfoils, commonly called vanes or stationary blades, inter-spaced between stages of rotating airfoils, commonly called blades. Turbo-machines are known to include an outer casing, a blade ring affixed to the casing, and a plurality of stationary blades affixed to the blade ring, as shown in U.S. Pat. No. 4,699,566, dated Oct. 13, 1987. As a working fluid passes through the turbine, a wake is formed in the working fluid by a first stage of vanes. This wake is known to pass through the following rotating stage of blades and on to the second stage of vanes. Similar interaction occurs between subsequent stages of the machine.

U.S. Pat. No. 5,486,091 dated Jan. 23, 1996, teaches that the relative positioning of two rows of vanes, also known as the clocking of the vanes, can affect the efficiency of a turbine engine.

The clocking effect is known to exist in various types of turbo-machines, including steam turbines, gas or combustion turbines and compressors. U.S. Pat. No. 5,681,142 dated Oct. 28, 1997, teaches that there exists a class of vibratory modes known as the clocking modes in the stator of a compressor. This patent teaches that there is a need to dampen and/or to minimize the magnitude of these clocking mode forces.

It is known to provide for the adjustment of the stationary blades of a gas turbine, as taught in U.S. Pat. No. 5,215,434 dated Jun. 1, 1993. That patent shows an apparatus for adjustment of the pitch of the vanes, i.e. the angle of attack of the airfoil relative to the direction of flow of the working fluid. It does not, however, teach or suggest an apparatus for adjusting the clocking of the stationary vanes.

The above mentioned U.S. Pat. Nos. 4,699,566; 5,486,091; 5,681,142; and 5,215,434 are incorporated by reference herein.

As turbine and compressor designs advance, there is a need to ensure that the optimum clocking is achieved in each machine in order to maximize the overall efficiency of the machine. Further, there is a need to adjust the clocking of stationary vanes in a machine subsequent to the initial operation of the machine in order to affect the efficiency and/or the vibration characteristics of the machine.

SUMMARY

Accordingly, it is an object of this invention to provide a turbo-machine having a mechanism to facilitate the adjustment of the clocking of the rows of stationary vanes. It is a further object of this invention to provide a method of assembling a turbo-machine that provides for the clocking of the rows of stationary vanes.

In order to achieve the above and other objects of the invention, a turbo-machine according to one aspect of this invention includes a casing that defines a gas flow path therethrough; a blade ring; a means for attaching the blade ring to the casing within the gas flow path; wherein the means for attaching further comprises a means for attaching the blade ring to the casing in a plurality of alternative radial positions.

In accordance with another aspect of this invention, a method is provided for assembling a turbo-machine having a casing defining a gas flow path, a blade ring disposed within the gas flow path and attached to the casing by a pin passing through the casing and contacting the blade ring, the method comprising the steps of: calculating a desired clocking angle for the blade ring; providing a first notch in the blade ring at a first radial location corresponding to the desired clocking angle; providing a second notch in the blade ring, the radial location of the second notch corresponding to a second clocking angle; and assembling the turbo-machine by inserting an end of the pin into the first notch.

DESCRIPTION OF THE PREFERRED EMBODIMENTS

Figure 1:
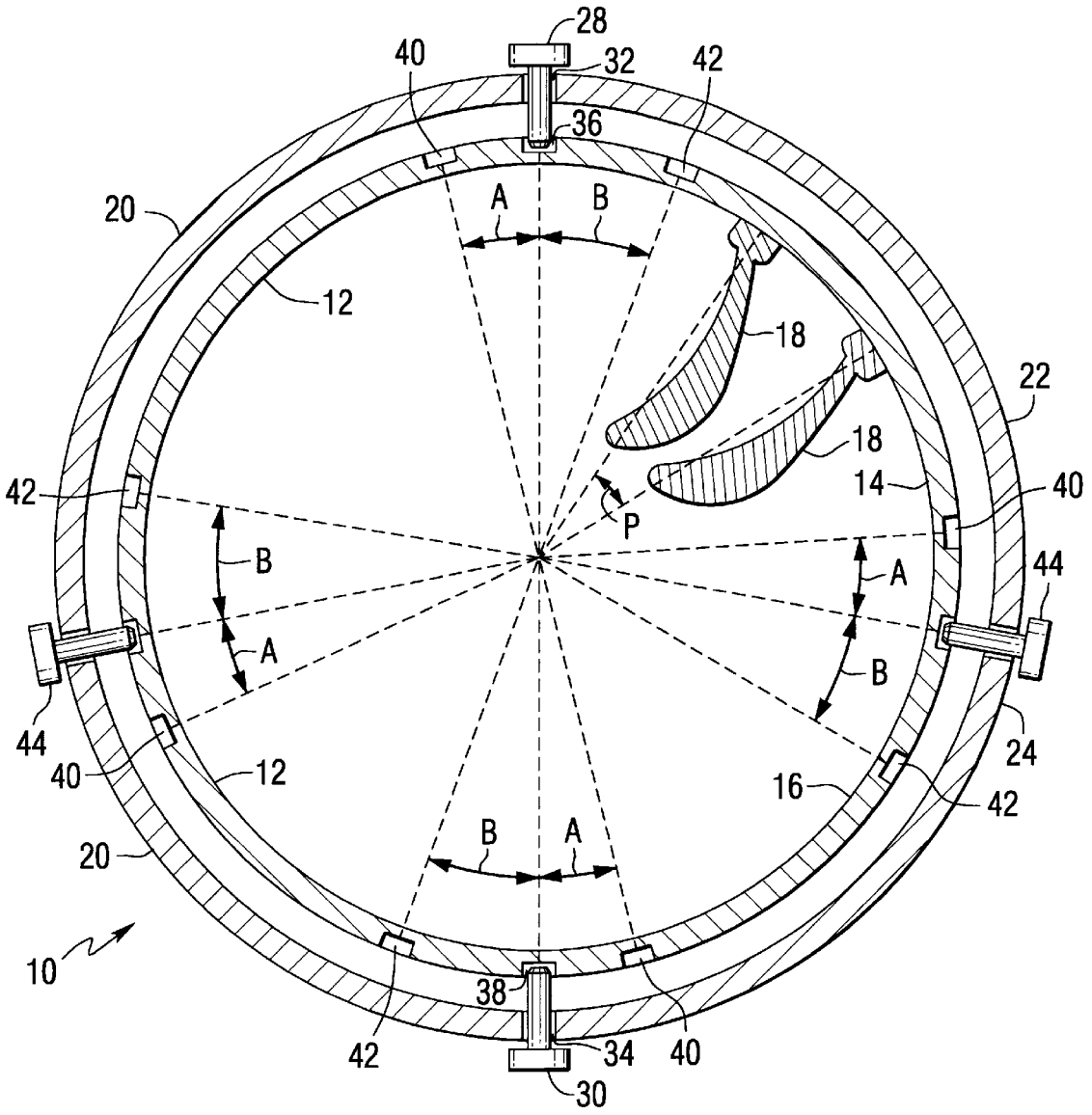
FIG. 1 is a cross sectional view of a turbo-machine in accordance with this invention.

FIG. 1 illustrates a blade ring 12 of a turbo-machine 10 such as a steam turbine, gas or combustion turbine, or compressor. The blade ring 12 is formed with an upper portion 14 and a lower portion 16 to facilitate the assembly of the turbo-machine. Removeably affixed to the blade ring 12 are N airfoils or vanes 18, only two of which are shown in FIG. 1 for the sake of clarity. The number N varies from machine to machine, but may typically be 32 or 48 for a gas turbine engine. The radial distance between adjacent airfoils is called a segment of P degrees. One segment P is equal to 360 degrees divided by N.

A single blade ring 12 and its N airfoils define a stage when installed in a gas flow path within the casing 20 of the turbo-machine 10. The casing 20 is also formed with an upper portion 22 and a lower portion 24. The flow path (not shown) would be in a direction perpendicular to the plane of the page of FIG. 1. The number of stages varies from machine to machine. By example, a typical gas turbine or compressor may have 4–6 stages, and a typical steam turbine may have 6–8 stages.

Figure 2:
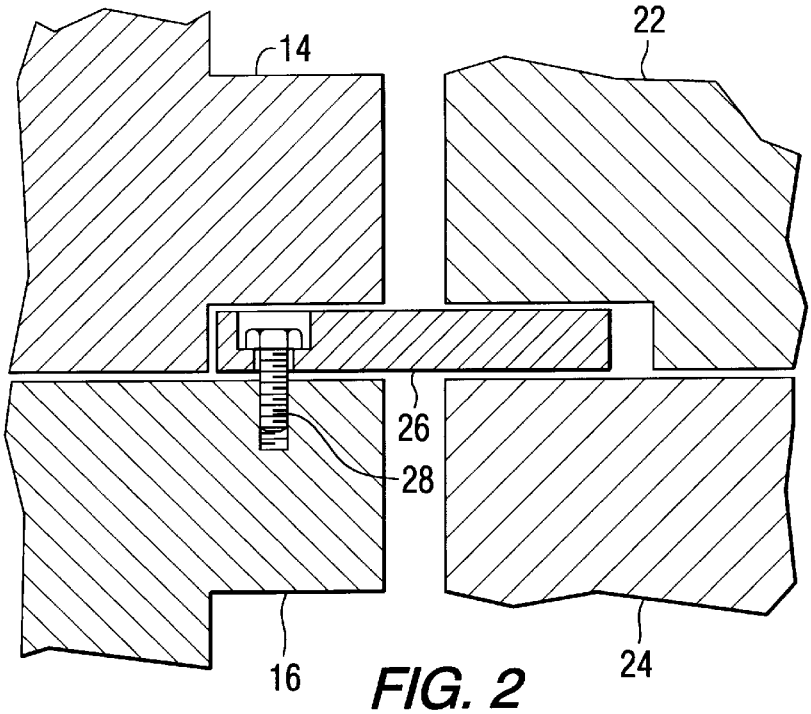
FIG. 2 PRIOR ART
FIG. 2 is a cross sectional view of a blade ring flange affixed to a turbo-machine casing as is known in the prior art.
Figure 3:
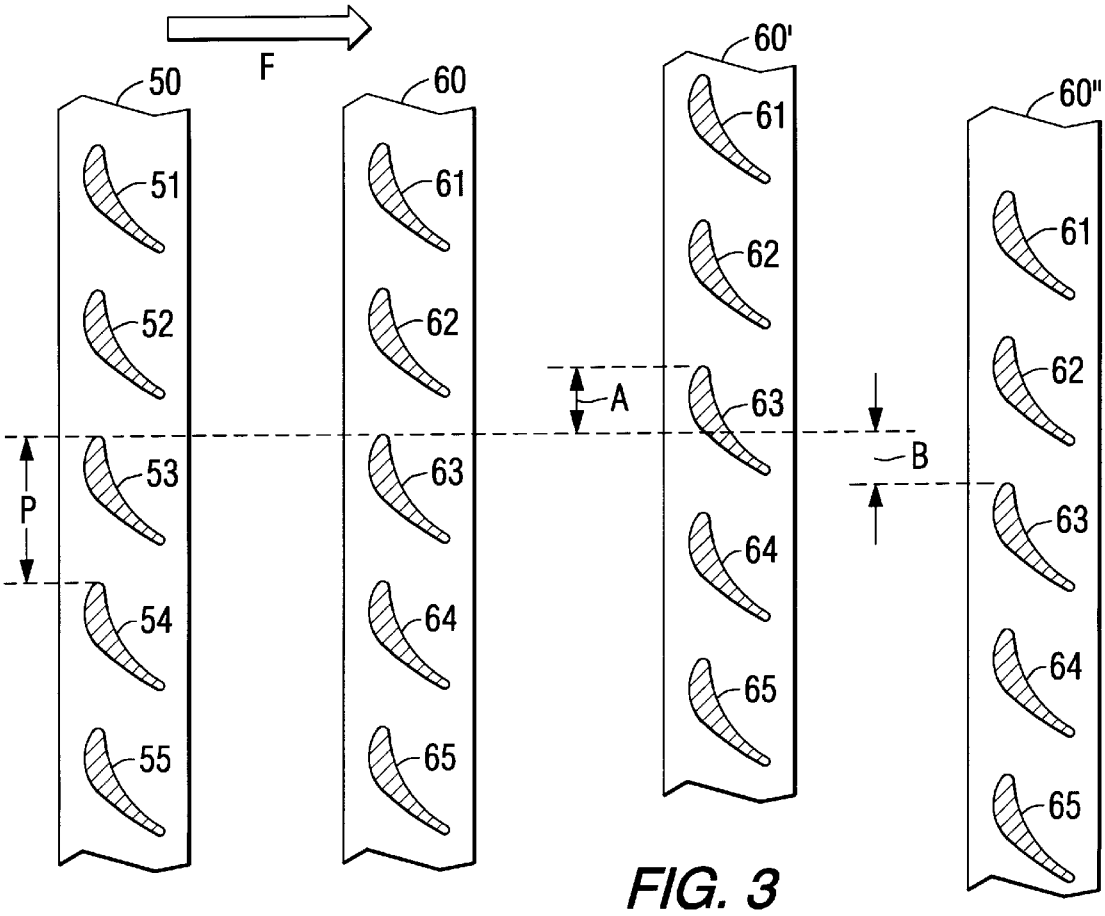
FIG. 3 is a radial view of two adjacent rows of stationary airfoils in three alternative clocking locations.

FIG. 2 illustrates how the blade ring 12 is affixed to the casing 20 of the turbo-machine 10. Identical structures are numbered consistently in FIGS. 1 and 2. The blade ring lower portion 16 is supported in the vertical and horizontal directions within the casing lower portion 24. A key 26 is affixed to the blade ring lower portion by bolt 28. The upper portion 14 of the blade ring 12 rests on and is supported in the vertical direction by the lower portion 16 of the blade ring 12. The upper portion 22 of the casing 20 is then positioned over the blade ring 12 and onto the casing lower portion 24, capturing the key 26 therebetween. The interference between the key 26 and the casing upper and lower portions 22,24 provides radial support for the blade ring 12.

As further illustrated in FIG. 1, torque pins 28,30 penetrate openings 32,34 in the casing upper and lower portions 22,24 respectively. The torque pins 28,30 are operable to be inserted into the casing 20 so that the ends of the pins 28,30 are received by notches 36,38 formed in the outer surface of the blade ring upper and lower portions 14,16. Torque pins 28,30 and notches 36,38 are known in the art. The alignment of notches 36,38 with torque pins 28,30 defines the radial position of the blade ring 12, and thereby the clocking position of that stage of the turbo-machine 10.

In accordance with this invention, blade ring 12 is provided with at least one and preferably a plurality of additional notches 40,42, and the casing is provided with clocking pins 44. Notches 40 are located a radial distance of A degrees clockwise from a reference position, and notches 42 are located a radial distance of B degrees counter-clockwise from a reference position. As illustrated in FIG. 1, the reference position corresponds to the alignment of known pins 28,30 and notches 36,38.

In order to change the clocking angle of the stage of vanes shown in FIG. 1, the blade ring 12 is rotated within the casing 20 until the clocking pins 44 align with notches 40 or 42, and torque pins 28,30 align with notches 40 or 42. Rotation of the blade ring 12 in either radial direction to a maximum of P degrees will change the clocking angle of the stage. Due to the symmetry of the arrangement of the airfoils 18 around the blade ring 12, a rotation of exactly P degrees results in the same clocking angle as the original position. It may be desirable, therefore, to rotate the blade ring 12 in any amount from 0 to P degrees.

The notches 36,40,42 must be designed to have a certain finite size based upon the calculated forces, material selection, and other mechanical design considerations. Due to the size of the notches and the stress concentration in the blade ring caused by the notches and the loads imposed by the pins, the notches 36,40,42 must be spaced a calculated distance apart from each other. Therefore, it may not be possible to form the desired number of notches corresponding to the desired number of clocking angles in a space of one segment of P degrees on the blade ring 12. Notches may, however, be formed in other segments of the blade ring 12 at a distance from the reference position equal to the desired change in clocking angle plus an integer multiple of the segment angle P. Similarly, a desired rotation in the clockwise direction may be achieved by forming a notch in the counterclockwise direction at a radial distance of P degrees minus the desired rotation angle.

FIG. 1 illustrates a turbo-machine having a means for attaching the blade ring to the casing at three alternative radial positions; i.e. at a reference position, at A degrees clockwise from the reference position, and at B degrees counterclockwise from the reference position. Radial distances A and B as well as the combination of A plus B are each non-integer multiples of the segment angle P, and A and B are non-integer multiples of each other, thereby providing three alternative clocking angles for the assembly of this segment of the turbo-machine. By way of example, A may be an angle less than P degrees and B may be an angle greater than P degrees. As long as A and B are not equal to each other and are each non-integer multiples of P and non-integer multiples of each other, three distinct clocking angles may be provided in the embodiment of FIG. 1.

To assemble a turbo-machine 10 in accordance with this invention, the designer may first calculate a desired clocking angle for the blade rings 12 of the various stages of the machine 10. A notch 36,38 is provided in the blade ring 12 at a reference radial location that corresponds to the location of pin 28,30 when the blade ring 12 is at the desired clocking angle. Additional notch 40 is provided in the blade ring 12. Additional notch 40 is located at a radial location A degrees counterclockwise from the reference notch 36,38. As long as A is a non-integer multiple of P, the blade ring will be clocked to a second clocking angle when additional notch 40 is aligned with pin 28,30,44. The turbo-machine may first be assembled with notches 36,38 aligned with pins 28,30, then if a second clocking angle is desired as a result of performance testing, modified operating conditions, or other reason, the turbo-machine 10 may be disassembled and re-assembled with notches 40 aligned with pins 28,30,44 to provide the second clocking angle.

As can be seen in FIG. 2, pin 26 must be removed to permit the rotation of the blade ring 12 to the alternative clocking angle positions. To provide additional support for the blade ring 12 after pin 26 is removed, clocking pins 44 are provided. The ends of clocking pins 44 are received by notches 40,42 after pin 26 is removed and the blade ring 12 is rotated. When the blade ring is in the reference position wherein pins 28,30 are aligned with notches 36,38 and key 26 is installed, the ends of pins 44 may be retracted as shown in FIG. 1, or may be inserted into additional notches (not shown) formed in the blade ring 12.

Providing the turbo-machine 10 with a third notch 42 allows the machine to be disassembled and re-assembled with the blade ring 12 at a third clocking angle, so long as the third notch 42 is provide at a radial distance B which is equal to a non-integer multiple of P and a non-integer multiple of A.

Other aspects, objects and advantages of this invention may be obtained by studying the figures, the disclosure, and the appended claims.

What is claimed is:

1. A turbo-machine comprising:

a casing that defines a gas flow path therethrough;

a blade ring that supports a row of stationary vanes positioned between rotating blades in the turbo machine;

a means for attaching said blade ring to said casing within said gas flow path; and wherein said means for attaching further comprises a means for attaching said blade ring to said casing in a plurality of alternative radial positions that establish different clocking angles.

2. The turbo-machine of claim 1, further comprising:

an opening formed in said casing;

a pin operable to be inserted through said opening;

a plurality of notches formed in said blade ring, said notches operable to receive an end of said pin, and wherein said alternative radial positions correspond to the alignment of said pin with said plurality of notches.

3. The turbo-machine of claim 2, further comprising:

a quantity of N airfoils attached to said blade ring; and wherein the circumference of said blade ring is defined to include a plurality of segments, each segment extending a radial angle of P degrees, where P equals 360 degrees divided by N; and wherein a first of said notches is formed at a radial distance equal to a non-integer multiple of P degrees from a second of said notches.

4. The turbo-machine of claim 3, wherein said radial distance is greater than P degrees.

5. The turbo-machine of claim 3, wherein said first notch is formed at a first radial distance from said second notch, and further comprising:

a third notch formed at a second radial distance from said second notch, said second radial distance being a non-integer multiple of said first radial distance.

6. A method of assembling a turbo-machine, said turbo-machine comprising a casing defining a gas flow path, a blade ring supporting stationary vanes disposed within said gas flow path between rotating blades and attached to said casing by a pin passing through said casing and contacting said blade ring, the method comprising the steps of:

calculating a desired clocking angle for said blade ring;

providing a first notch in said blade ring at a first radial location corresponding to said desired clocking angle;

providing a second notch in said blade ring, the radial location of said second notch corresponding to a second clocking angle;

assembling said turbo-machine by inserting an end of said pin into said first notch.

7. The method of claim 6, further comprising the steps of:

disassembling said turbo-machine, and re-assembling said turbo-machine by inserting said end of said pin into said second notch.

8. The method of claim 6, wherein said turbo-machine comprises a quantity of N airfoils attached to said blade ring; and wherein the circumference of said blade ring is defined into a plurality of segments, each segment having a radial pitch angle of P degrees, where P equals 360 degrees divided by N; and further comprising the step of providing said second notch at a radial distance equal to a non-integer multiple of P degrees from said first notch.

9. The method of claim 8, wherein said first notch is formed at a first radial distance from said second notch, and further comprising the step of:

forming a third notch at a second radial distance from said second notch, said second radial distance being a non-integer multiple of said first radial distance.

10. The method of claim 9, wherein said second radial distance is a non-integer multiple of P.

* * * * *